United States Patent [19]

Donaho, Jr.

[11] 3,935,114

[45] Jan. 27, 1976

[54] LOW-WEAR GREASE FOR JOURNAL BEARINGS

[75] Inventor: Ruel M. Donaho, Jr., Houston, Tex.

[73] Assignee: Hughes Tool Company, Houston, Tex.

[22] Filed: Dec. 4, 1974

[21] Appl. No.: 529,302

Related U.S. Application Data

[63] Continuation of Ser. No. 292,021, Sept. 25, 1972, abandoned.

[52] U.S. Cl. ..... 252/18; 252/25

[51] Int. Cl.[2]. C10M 3/18; C10M 5/14; C10M 7/20; C10M 7/24

[58] Field of Search ..... 252/18, 25

[56] References Cited

UNITED STATES PATENTS

| | | | |
|---|---|---|---|
| 3,194,760 | 7/1965 | Davis | 252/18 |
| 3,223,626 | 12/1965 | Murphy et al. | 252/25 |
| 3,396,108 | 8/1968 | Caruso | 252/18 |
| 3,472,770 | 10/1969 | Preston et al. | 252/18 |

*Primary Examiner*—Delbert E. Gantz
*Assistant Examiner*—I. Vaughn
*Attorney, Agent, or Firm*—Robert A. Felsman

[57] ABSTRACT

A low-wear grease for journal bearings characterized by a high temperature, multi-purpose heavy duty hydrocarbonaceous lubricant that is thickened by calcium acetate complex to form a lubricating grease having an ASTM worked penetration no less than 265; and molybdenum disulfide and a selected class of metallic oxide in effective and synergistic amounts. Surprisingly, better lubrication is provided when the molybdenum disulfide particles are non-uniform in size so they have a range of sizes, including some fine and some relatively coarse but are small enough to pass 100 percent through a 100 mesh screen, and 85 percent through a 325 mesh screen. The metallic oxide is either antimony trioxide or a mixture of substantially equal parts of antimony trioxide, zinc oxide, lead oxide, nickel oxide, tungsten trioxide, vanadium pentoxide and copper oxide. The particles of the metallic oxide are small enough to pass 90 percent through a 325 mesh screen. All particles are uniformly dispersed in the thickened, heavy duty lubricating grease.

11 Claims, No Drawings

LOW-WEAR GREASE FOR JOURNAL BEARINGS

This is a continuation, of application Ser. No. 292,021, filed Sept. 25, 1972 and now abandoned.

BACKGROUND OF THE INVENTION

1. Field of the Invention

This invention relates to new grease compositions; and, more particularly, to improved, low-wear grease for heavy duty, high temperature applications, such as for journal bearings on bits drilling into hot subterranean formations.

2. Description of the Prior Art

Complex-thickened greases are well known in the art. For example, an excellent discussion is contained in the ENCYCLOPEDIA OF CHEMICAL TECHNOLOGY, KIRK-Othmer, Second Edition, A. Standen, Editor, Interscience Publishers, John Wiley & Sons, Inc., New York, N.Y., 1967, pages 582–587. Also, it is known to employ certain complexes; such as, the calcium-acetate-containing complexes and the lithium-hydroxy-stearate-containing complexes; to provide high temperature stability and maintain lubrication properties at the high temperatures to which the greases may be subjected.

Lubricating a drill bit drilling in hot (frequently above 300°F) subterranean formations is one of the most severe and demanding set of conditions ever posed for a lubricant. The drilling takes place in an abrasive atmosphere of drilling mud and rock particles thousands of feet from the engineer or supervisor, who does not have benefit of oil pressure gauges or temperature sensors at the surfaces to be lubricated. The lubricant should have properties that enable flow through passageways to the surfaces to be lubricated and that prevent solid lubricant particles from settling out.

The best available lubricants heretofore have not satisfactorily minimized wear under the heavy load conditions encountered by earth boring drill bits having friction bearings.

The prior art shows solid extreme pressure (EP) additives have been employed to attempt to enhance the lubrication properties of oils and greases. For example, molybdenum disulfide has been used in a wide variety of lubricants, as noted in U.S. Pat. Nos. 3,062,741, 3,170,878, 3,281,355 and 3,384,582. The prior art has taught, however, that the molybdenum disulfide should comprise fine particles having an average diameter less than 10 microns and some prefer less than 2 microns.

Also, it is known to include metallic oxides like zinc oxide in other lubrication oils. Moreover, U.S. Pat. No. 2,736,700 describes the use of molybdenum disulfide and a metallic oxide, such as fumed lead oxide and zinc oxide in a ratio of 2 parts molybdenum disulfide to 1 part metallic oxide, in a paint-on composition, or bonded lubricant, containing a lacquer drying agent. The bonded lubricant is described for drawing tough metals, such as uranium, thorium, zinc and titanium. Such bonded lubricants are inadequate and could not be employed in the low-wear, heavily loaded applications for which this invention was engineered.

Insofar as I am aware, the prior art has not provided a heavy duty lubricant employing a hydrocarbonaceous grease that is calcium acetate complex thickened for temperature stability and that has the superior lubricating properties of this invention; particularly, that could be employed in the application of lubricating journal bearings in bits drilling in an abrasive atmosphere thousands of feet from the engineer or supervisor; or under conditions that are similarly severe and demanding of the grease.

SUMMARY OF THE INVENTION

Accordingly, it is a primary object of this invention to provide a grease that is temperature stable and that can be employed under severe and demanding conditions; such as, for lubricating journal bearings of bits penetrating subterranean formations; by providing a degree of protection not heretofore available at the extreme pressure, high temperature atmosphere conditions to which the lubricant will be subjected.

It is a particular object of this invention to provide a grease that has physical properties, such as a worked penetration, sufficient to flow to the surfaces to be lubricated; and not flow out of the bit but to provide lubrication and protection greater than available heretofore at temperatures in excess of 300°F.

These and other objects will become apparent from the following descriptive matter.

In accordance with this invention, the superior grease consists essentially of a substantially uniform dispersion including:

a. a multi-purpose heavy duty hydrocarbonaceous lubricant thickened by a calcium acetate complex to form a heavy duty lubricating grease that is stable at high temperatures and that has an American Society for Testing Materials (ASTM) worked penetration no less than 265; and effective and synergistic amounts of the solid additives of:

b. molybdenum disulfide ($MoS_2$) powder; and c. metallic oxide powder; the metallic oxide being selected from the group consisting of antimony trioxide ($Sb_2O_3$); and a mixture of substantially equal parts of antimony trioxide, zinc oxide (ZnO), lead oxide (PbO), nickel oxide ($Ni_2O_3$), tungsten trioxide ($WO_3$), vanadium pentoxide ($V_2O_5$) and copper oxide ($CuO/Cu_2O$).

The effective and synergistic amounts of the powdered solid additives in the lubricating grease preferably includes at least 7 percent by weight of molybdenum disulfide and at least 5 percent by weight of the metallic oxide when employed in a downhole bit. The percent by weight is based on the final weight of grease. The powder is also preferably made up of a range of non-uniform particle sizes, as delineated hereinafter.

A particularly preferred grease consists essentially of the lubricating grease containing 11–20 percent by weight of the molybdenum disulfide and 5–20 percent by weight of the metallic oxide. Other non-detrimental additives, such as graphite, may be employed if desired.

DESCRIPTION OF PREFERRED EMBODIMENT(S)

The grease of this invention, with its superior lubrication properties, is prepared by dispersing uniformly in a conventional high temperature, calcium acetate complex thickened lubricating grease, the desired effective and synergistic amounts of molybdenum disulfide and the metallic oxide chosen. The molybdenum disulfide and the metallic oxide additives can be incorporated into the grease at almost any stage in the manufacture of the final product, dependent upon the convenience with respect to the particular grease plant. For example, they can be incorporated when the thickener is added; or, ordinarily, they can be incorporated at some stage in the handling of the semi-finished product. The important feature is that sufficient mixing should be employed; as by working, homogenizing, or otherwise; to secure a complete, uniform, and thorough dispersion of the particles of the molybdenum disulfide and the metallic oxide throughout the grease.

Considering the constituents of the grease, the "lubricating grease", as used herein, denotes a high temperature, multi-purpose heavy duty hydrocarbonaceous lubricant that has been thickened by a calcium acetate complex. The lubricating grease has an ASTM D-217 test, in depth of penetration in tenths of a millimeter in five seconds at 77°F, no less than 265. The lubricating grease has a National Lubricating Grease Institute (NLGI) classification of less than class 3 to effect the requisite flow through passageways to reach and lubricate the surfaces of interfacing elements, such as bearings. Thus, the lubricating grease falls in the NLGI class 00, class 0, class 1, or class 2. The methods of dispersion and the NLGI table of classification, including physical properties for the classes, is included in the above-referenced ENCYCLOPEDIA OF CHEMICAL TECHNOLOGY; for example, the NLGI classification table is included at page 586. Accordingly, this voluminous material need not be duplicated herein. The greases employ a calcium complex type of thickener that contains calcium acetate as a primary ingredient. A suitable lubricating grease is the Amdex No. 0 EP or the No. 1 EP, available from American Oil Company. The satisfactory Amdex greases have the specifications set forth in Table I.

Table I

| Property | Amdex Grease No. 0 EP | Amdex Grease No. 1 EP |
|---|---|---|
| Worked Penetration, 60 strokes | 369 | 325 |
| Worked Penetration, 100,000 strokes | 382 | 343 |
| Viscosity of Oil at 100°F, SUS | 900 | 900 |
| Viscosity index of oil | 90 | 90 |
| Timken EP, lbs. pass | 55 | 55 |
| Dropping point, °F | 500+ | 500+ |
| Bearing rust protection test | No. 1 | No. 1 |
| Bomb oxidation, psi* drop/100 hrs. | 3 | 3 |
| Copper corrosion | Pass | Pass |
| Roll stability, 20 hrs., % change | +2.6 | +5.1 |
| Oil separation, 24 hrs. at 210°F % | 2.9 | 2.0 |

*psi — pounds per square inch
lbs. — pounds
hrs. — hours
SUS — Saybolt universal seconds
% — percent Other calcium-acetate-complex thickened greases; such as those described in U.S. Pat. No. 2,999,065 and U.S. Pat. No. 2,999,066 should be satisfactory, although they have not been tested. In any event, the lubricating grease should have lubricating properties, before addition of the solid additives, sufficient to provide a Shell 4-ball EP scar diameter of 1.3 millimeters (mm) maximum after five minutes (min.) at 900 revolutions per minute (rpm) under 200 kilogram (kg).

The particulate molybdenum disulfide, as indicated hereinbefore, is small enough to pass 100 percent through a 100 mesh per inch screen, and 85 percent through a 325 mesh screen such that it may be easily substantially uniformly dispersed throughout the lubricating grease. The percents are by weight. I have found, surprisingly, that molybdenum disulfide having a complete range of particle sizes, some fine and some coarse, affords better extreme pressure lubrication properties than classified, relatively uniform sizes of less than 10 microns, or even less than 2 microns, as taught by the prior art. A satisfactory commercial grade of molybdenum disulfide is Esco, available from Dow Corning as No. 3490 molybdenum disulfide that is not size-segregated and has the desired range of particle sizes. The Esco molybdenum disulfide meets the foregoing criteria and has about 2–4 percent retained on a 200 mesh screen.

The particulate metallic oxide is small enough to pass 100 percent through a 100 mesh screen and 90 percent through a 325 mesh screen such that the metallic oxide may be readily substantially uniformly dispersed in the lubricating grease. A satisfactory metallic oxide comprises a mixture of substantially equal parts of antimony trioxide, zinc oxide, lead oxide, nickel oxide, tungsten trioxide, vanadium pentoxide and copper oxide. I have found it preferable, however, to employ the single oxide of antimony trioxide to obtain superior results without the bother of having to blend the mixture of oxides. A satisfactory commercial grade of antimony oxide is White Star M, available from Harshaw Chemical Company as a fine powder. The satisfactory antimony trioxide has the properties set forth in Table II.

Table II

| Chemical or Element | Specifications |
|---|---|
| $Sb_2O_3$* | 99.00% min. |
| Pb* | 0.05% max. |
| Cu* | 0.004% max. |
| Ni* | 0.004% max. |
| As* | 0.05% max. |
| Fe* | 0.007% max. |
| $SO_4$* | 0.01% max. |
| Physical properties (typical) | |
| Specific gravity | 5.72 |
| Oil absorption | 10.0 |
| Reflectance in Oil | 92% |
| Color (masstone) | Excellent white |
| Tint Strength | Pigment quality |
| Residue on 325 mesh | 0.022% |

*Symbols used in accordance with the Periodic Table

A grease that is minimally satisfactory for a drill bit is provided by the inclusion of as little as 7 percent molybdenum disulfide and 5 percent metallic oxide into the lubricating grease. It is preferred, however, that an amount within the range illustrated in Table III be employed. The amounts in Table III are percent by weight based on a uniform dispersion in the final grease composition and are incorporated into the lubricating grease described hereinbefore.

TABLE III

| | $MoS_2$ | Metallic Oxides | Graphite | Total |
|---|---|---|---|---|
| Lower limits | 11% | 5% | 0% | 16% |
| Optimum | 13 | 7 | 0 | 20 |
| Upper limits | 20 | 20 | 5 | 36 |

As noted from the total percentage in Table III, the maximum amount of molybdenum disulfide would not be employed with the maximum amount of the metallic oxides, since no more than 36 percent of solid EP additives is employed, preferably.

The following examples illustrate satisfactory greases prepared in accordance with this invention. Different size batches were prepared and tested on the Shell 4-ball EP tester. The Shell 4-ball EP tester has been demonstrated to give excellent results in testing a lubricant for extremely severe and demanding steel-sliding-on-steel applications. The Shell 4-ball EP tester has been described in the literature and is well known so it need not be described herein. Basically, a lubricant is tested in contact with four balls, the top ball being rotated while loaded. After a predetermined length of time the diameter of the wear scar is measured. The smaller the scar dimension is, the better the lubricant is. Finally, a table, Table IV, summarizes several of the many compositions, including tests on compositions similar to those delineated in the Examples, tried in arriving at the grease of this invention.

EXAMPLE I

This example illustrates the best grease yet prepared.

Respective amounts of molybdenum disulfide and antimony trioxide were added to the Amdex 0 EP lubricating grease to form a grease that had 14 percent molybdenum disulfide by weight and 7 percent antimony trioxide by weight with 79 percent Amdex 0 EP.

A similar grease was formed by adding 13 percent molybdenum disulfide and 7 percent antimony trioxide to 80 percent of Amdex 0 EP lubricating grease effected a final product that was almost equally as satisfactory.

EXAMPLE II

Another grease that performed satisfactorily was made by adding respective amounts of molybdenum disulfide and a mixture of substantially equal parts of metallic oxides to the Amdex O EP lubricating grease to form a uniform admixture containing 14 percent molybdenum disulfide and 7 percent metallic oxides. The metallic oxides had substantially equal parts of antimony trioxide, zinc oxide, lead oxide, nickel oxide, tungsten trioxide, vanadium pentoxide and the copper oxides. The copper oxides comprised both cuprous and cupric oxide in about equal portions, although they combined to form an amount equal to that of the respective other oxides employed. This grease was almost as good as those of Example 1, as shown in Table IV.

EXAMPLE III

In this example, graphite in the same range of particle sizes as described with respect to molybdenum disulfide and the antimony trioxide were added to a variety of grease formulations. In general, the substitution of the graphite for either the molybdenum disulfide or the antimony trioxide resulted in an inferior grease. The graphite could be included, however, in addition to the satisfactory effective and synergistic amounts of the molybdenum disulfide and the metallic oxide, such as antimony trioxide, without adversely affecting the properties of the grease. The data are summarized in Table IV hereinafter.

Table IV summarizes a variety of compositions that were tried and illustrates some satisfactory and unsatisfactory compositions that were surprising. Table IV summarizes the results in terms of the scar diameters obtained in the Shell 4-ball EP tests on different greases, and inspection of worn journal bearings after a simulated run, referred to as "Journal Bearing Test" in Table IV.

Table IV

| Formulation and Remarks | Weight % Solid EP Additives | | | | Avg. EP Scar Diameter (mm) | | | Journal Bearing Test |
|---|---|---|---|---|---|---|---|---|
| | $MoS_2$ | $Sb_2O_3$ | Oxide Mix* | Graphite | 900 rpm 500 KG | 900 rpm 550 KG | 1800 rpm 300 KG | |
| 1. grease employing lithium hydroxy stearate thickener; large scar diameter | 14 | 7 | | | 1.97** | | W | |
| 2. same grease, additional additives, no improvement | 15 | 15 | | | 1.96** | | W | |
| 3. Amdex 0 EP + $MoS_2$ | 7 | | | | 1.49 | 1.62 | W, 1.43 | |
| 4. Amdex 0 EP + additional $MoS_2$: no improvement | 19 to 24 | | | | 1.56 | 1.55 | 1.44 | |
| 5. Amdex 0 EP + $MoS_2$ + small amount $Sb_2O_3$, 3% $Sb_2O_3$ is better than 15% $MoS_2$ | 7 | 3 | | | 1.51 | 1.57 | | |
| 6. Amdex 0 EP + $MoS_2$ + more $Sb_2O_3$: appreciable improvement | 7 | 5 to 10 | | | 1.43 | 1.56 | 1.39 | |
| 7. 6 + graphite; graphite apparently not detrimental | 7 | 7 | | 7 | 1.44 | 1.55 | | |
| 8. Amdex 0 EP, preferred composition, appreciable improvement over other compositions tested | 11 to 16 | 5 to 20 | | | 1.35 | 1.49 | 1.25 | Very good |
| 9. 8 + graphite; graphite apparently not detrimental | 13 | 7.5 | | 5 | 1.34** | | 1.25 | |
| 10. mixed oxides* in lieu of $Sb_2O_3$; almost as good as $Sb_2O_3$ | 13 | | 7 | | 1.38 | 1.47 | | Good |
| 11. graphite in lieu of $MoS_2$; bearing galled | 6 | | 5 | 9.5 | 1.35 | 1.49 | | Galled |
| 12. less oxides than 11; bearing galled | 10 | | 3.5 | 5 | 1.38 | 1.49 | | Galled |

*Equal parts (by weight): $Sb_2O_3 + ZnO + PbO + Ni_2O_3 + WO_3 + V_2O_5 + (CuO + Cu_2O)$

**400 KG load instead of 500 KG  W = Welded during 4-ball EP test

As can be seen from Table IV, there are effective and synergistic amounts of the solid additives. For example, run 5 indicates that 3% of the metallic oxide added to at least 7% of $MoS_2$ is better than 15% of additional $MoS_2$. Adding a little more metallic oxide up to 5% effected significant improvement. Attempts to substitute graphite for one or more of the ingredients did not produce a satisfactory grease. The addition of the $MoS_2$ and $Sb_2O_3$ did not sufficiently improve the performance of the grease that had been thickened with lithium hydroxy stearate (see runs 1. and 2.), as they did for the calcium-acetate-complex-thickened grease. This invention takes advantage of the surprisingly low wear obtained using the combination calcium-acetate-complex-thickened grease and the minimum concentration of the $MoS_2$ and the metallic oxides uniformly dispersed therein. In fact, by using the delineated effective and synergistic amounts of the solid additives, the final grease will lubricate sufficiently to effect a Shell 4-ball EP scar diameter of about 1.4 millimeters maxmium after five minutes at 900 revolutions per minute under 500 kilograms load. This represents outstanding preformance.

Having thus described the invention, it will be understood that such description has been given by way of illustration and example and not by way of limitation, reference for the latter purpose being had to the appended claims.

What is claimed is:

1. A heavy duty lubricating grease consisting essentially of a substantially uniform dispersion including:

a. a multi-purpose heavy duty hydrocarbonaceous lubricant thickened by a calcium acetate complex to form a lubricating grease that is stable at high temperature and that has an ASTM worked penetration of no less than 265; and effective and synergistic amounts of:

b. powdered molybdenum disulfide; and c. powdered metallic oxide; said metallic oxide being selected from the group consisting of antimony trioxide; and a mixture of substantially equal parts of antimony trioxide, zinc oxide, lead oxide, nickel oxide, tungsten trioxide, vanadium pentoxide and copper oxide;

such that said heavy duty lubricating grease can be prepared to have a Shell 4-ball EP scar diameter of about 1.4 millimeters maximum after 5 minutes at 900 revolutions per minute at 500 kilograms load.

2. A heavy duty lubricating grease consisting essentially of a substantially uniform dispersion including:

a. a multi-purpose heavy duty hydrocarbonaceous lubricant thickened by a calcium acetate complex to form a lubricating grease that is stable at high temperatures and has an ASTM worked penetration of no less than 265; and effective and synergistic amounts of:

b. particles of molybdenum disulfide that are small enough to pass 100 percent through a 100 mesh screen and 85 percent through a 325 mesh screen, c. particles of antimony trioxide that are small enough to pass 100 percent through a 100 mesh screen and 90 percent through a 325 mesh screen, such that said heavy duty lubricating grease can be prepared to have a Shell 4-ball EP scar diameter of about 1.4 millimeters maximum after 5 minutes at 900 revolutions per minute under 500 kilograms load.

3. A heavy duty lubricating grease consisting essentially of a substantially uniform dispersion including:

a. a multi-purpose heavy duty hydrocarbonaceous lubricant thickened by a calcium acetate complex to form a lubricating grease that is stable at high temperatures and has an ASTM worked penetration of no less than 265; and effective and synergistic amounts of:

b. particles of molybdenum disulfide that are small enough to pass 100 percent through a 100 mesh screen and 85 percent through a 325 mesh screen;

c. particles of metallic oxide consisting of a mixture of substantially equal parts of antimony trioxide, zinc oxide, lead oxide, nickel oxide, tungsten trioxide, vanadium pentoxide and copper oxide; said metallic oxide particles being small enough to pass 100 percent through a 100 mesh screen and 90 percent through a 325 mesh screen;

such that said heavy duty lubricating grease can be prepared to have a Shell 4-ball EP scar diameter of about 1.4 millimeters maximum after 5 minutes at 900 revolutions per minute under 500 kilograms load.

4. A heavy duty lubricating grease consisting essentially of a substantially uniform despersion including:

a. a multi-purpose heavy duty hydrocarbonaceous lubricant thickened by a calcium acetate complex to form a lubricating grease that is stable at high temperatures and has an ASTM worked penetration of no less than 265; and b. small particles of molybdenum dislufide in an amount of at least 7 percent by weight of said grease; said molybdenum disulfide particles having a range of particle sizes, including some fine particles and some coarse particles; and being small enough to pass 100 percent through a 100 mesh screen and 85 percent through a 325 mesh screen;

c. small particles of metallic oxide in an amount of at least 5 percent by weight of said grease; said metallic oxide being selected from the group consisting of antimony trioxide; and a mixture of substantially equal parts of antimony trioxide, zinc oxide, lead oxide, nickel oxide, tungsten trioxide, vanadium pentoxide and copper oxide; said metallic oxide particles being small enough to pass 100 percent through a 100 mesh screen and 90 percent through a 100 mesh screen and 90 percent through a 325 mesh screen;

such that said heavy duty lubricating grease has a Shell 4-ball EP scar diameter of about 1.4 millimeters maximum after 5 minutes at 900 revolutions per minute under 500 milograms load.

5. The grease of claim 1 wherein said lubricating grease is in the National Lubricating Grease Institute class number lower than class 3, and has sufficient lubricating properties to effect a Shell 4-ball EP scar diameter of about 1.3 millimeters maximum after five minutes at 900 revolutions per minute under 200 kilogram load.

6. The grease of claim 5 wherein said lubricating grease is in NLGI class 0, passes a Timken EP bearing test of 55 pounds, has a dropping point in excess of 500°F, and employed a hydrocarbonaceous oil with a viscosity index of about 90 and a Saybolt Universal Seconds viscosity of 100°F of about 900, so as to be useful in bits drilling in hot subterranean formations.

7. The grease of claim 4 wherein said molybdenum disulfide is present in an amount within the range of 11–20 percent by weight.

8. The grease of claim 7 wherein said molydenum disulfide is present in an amount of about 13 percent by weight.

9. The grease of claim 4 wherein said metallic oxide is present in an amount within the range of 5–20 percent by weight.

10. The grease of claim 9 wherein said metallic oxide is present in an amount of about 7 percent by weight.

11. The grease of claim 4 wherein said molybdenum disulfide is present as a solid EP additive in an amount within the range of 11–20 percent by weight; said metallic oxide is present as a solid EP additive in an amount within the range of 5–20 percent by weight; and wherein graphite, as another solid EP additive, is present in an amount of no more than 5 percent by weight; and the total amount of EP solid additives is no more than 36 percent by weight.

* * * * *